US010100990B1

(12) United States Patent
Huang

(10) Patent No.: US 10,100,990 B1
(45) Date of Patent: Oct. 16, 2018

(54) ARTIFICIAL LED CANDLE

(71) Applicant: Liwei Huang, Shenzhen (CN)

(72) Inventor: Liwei Huang, Shenzhen (CN)

( * ) Notice: Subject to any disclaimer, the term of this patent is extended or adjusted under 35 U.S.C. 154(b) by 0 days.

(21) Appl. No.: 15/922,846

(22) Filed: Mar. 15, 2018

(30) Foreign Application Priority Data

Nov. 10, 2017 (CN) ..... 2017 2 1495692
Jan. 8, 2018 (CN) ..... 2018 2 0025932

(51) Int. Cl.

| | |
|---|---|
| ***F21S 10/04*** | (2006.01) |
| ***F21S 6/00*** | (2006.01) |
| ***F21S 9/02*** | (2006.01) |
| ***F21V 3/02*** | (2006.01) |
| ***F21V 17/06*** | (2006.01) |
| *F21W 121/00* | (2006.01) |
| *F21Y 115/10* | (2016.01) |

(52) U.S. Cl.
CPC ..... *F21S 10/04* (2013.01); *F21S 6/001* (2013.01); *F21S 9/02* (2013.01); *F21V 3/02* (2013.01); *F21V 17/06* (2013.01); *F21W 2121/00* (2013.01); *F21Y 2115/10* (2016.08)

(58) Field of Classification Search
CPC ... F21S 10/04; F21S 6/001; F21S 9/02; F21V 3/02; F21V 17/06
See application file for complete search history.

(56) References Cited

U.S. PATENT DOCUMENTS

| | | | | |
|---|---|---|---|---|
| 9,523,470 | B2 * | 12/2016 | Lai | F21S 10/046 |
| 9,752,741 | B2 * | 9/2017 | Patton | F21S 6/001 |
| 2007/0223216 | A1 | 9/2007 | Jensen et al. | |
| 2016/0053954 | A1 | 2/2016 | Lai | |

* cited by examiner

*Primary Examiner* — Thomas M Sember
(74) *Attorney, Agent, or Firm* — Hemisphere Law, PLLC; Zhigang Ma

(57) ABSTRACT

An artificial LED candle includes a flame element with an upper section with a flame silhouette outlook, at least one first LED light source used for illuminating a center part of the upper section of the flame element, and at least one second LED light source used for illuminating one or two side parts of the upper section of the flame element. The center part of the upper section is illuminated by both the first and the second LED light sources, while the two side parts of the upper section is illuminated only by the second LED light source. Therefore, a center part is brighter than the two side parts of the upper section of the flame element, just like a real burning candle flame. Color simulation and light shadow presented on the flame element is more realistic, a simulate effect is improved.

15 Claims, 3 Drawing Sheets

ARTIFICIAL LED CANDLE

BACKGROUND OF THE INVENTION

1. Field of the Invention

The present invention relates to an artificial LED candle.

2. Description of Related Art

LED (Light Emitting Diode) is under rapid development due to its multiple advantages, including fast reaction, great shock resistance, extraordinary endurance, energy-saving and environment-friendly in special. LED lights have become an indispensable part of daily life of people as they gradually replace traditional incandescent and fluorescent, etc.

Candle is needed to foil atmosphere in some special occasions, such as cafes, bars, stage or temples, etc. However, the candle can cause smoke when its wick burns, and there is also a potential risk of fire in the same time. As a result, artificial LED candles have begun to appear on the market, but most of them in the market currently use fixed light bulbs or lamp shades to cover the LED light sources, which cannot present the scenarios of swing flame of a burning candle. For example, US Pat. App. Pub. No. 20070223216 A1 to Jensen et al published Sep. 27, 2007 discloses an artificial candle including an elastically flexible translucent flame piece simulating a candle flame and a base simulating a wax candle. The flame piece can not swing.

Therefore, artificial candles with movable flame part appear. Like the dynamic flame simulating device disclosed by US Pat. App. Pub. No. 20160053954 A1 to Wen-Cheng Lai, published on Feb. 25, 2016. However, the light shades of the flame is monotonous, and a middle part and side parts of a real candle flame have different shades of color, so the existing artificial LED candle has a poor simulation effect.

BRIEF DESCRIPTION OF THE SEVERAL VIEWS OF THE DRAWING(S)

The foregoing and other exemplary purposes, aspects and advantages of the present invention will be better understood in principle from the following detailed description of one or more exemplary embodiments of the invention with reference to the drawings, in which.

DETAILED DESCRIPTION OF THE INVENTION

Figure 1:
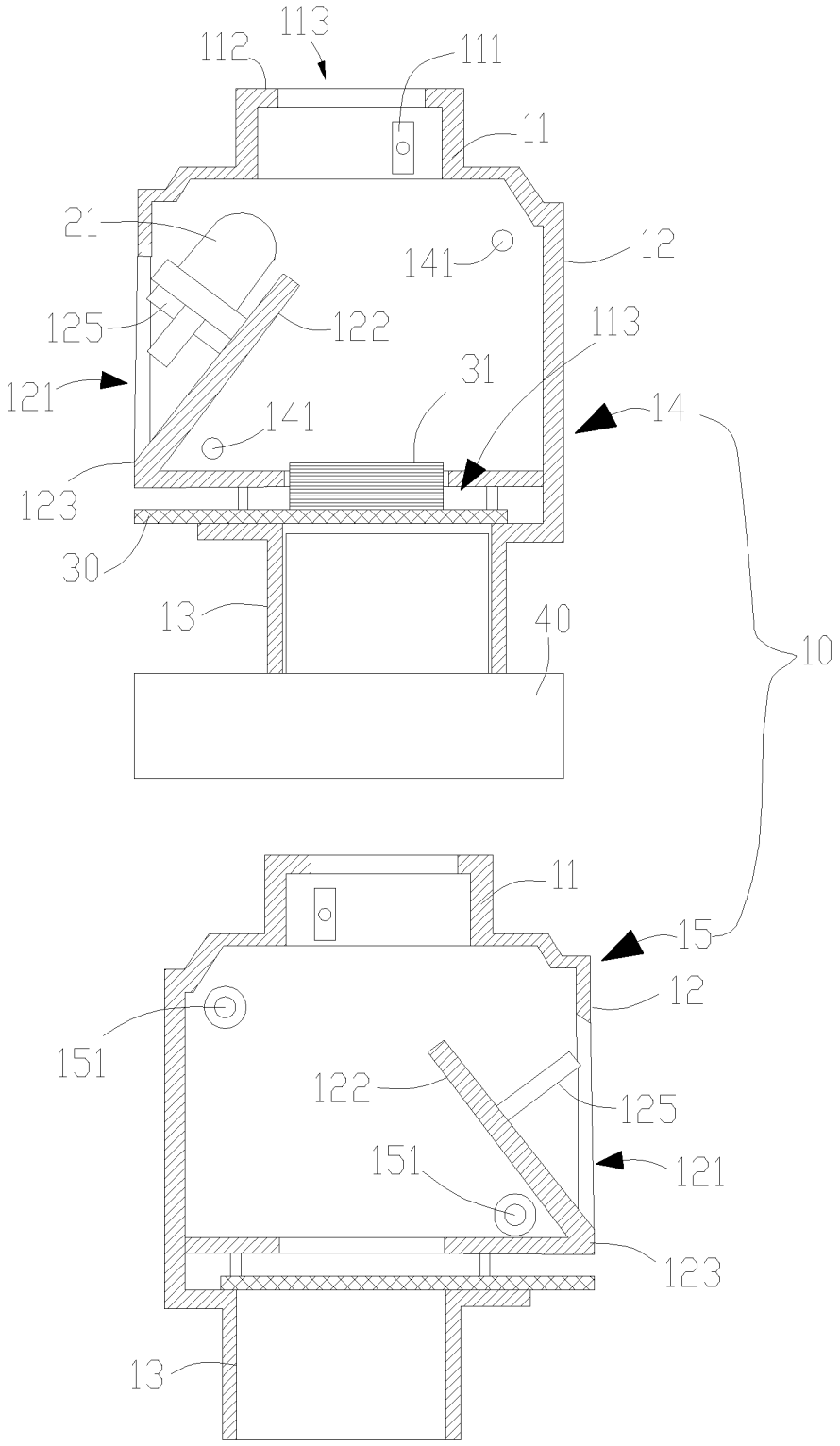
FIG. 1 is a cross-sectional view of a first part and a second part of a housing, installed with LED light sources, a circuit board, and a cell box, of an artificial LED candle in accordance with an embodiment of the present invention.

The invention will now be described in detail through several embodiments with reference to the accompanying drawings.

Referring to FIG. 1 to FIG. 5, an artificial LED candle in accordance with an embodiment of the present invention includes a housing 10, a first LED light source 21, a second LED light source 22, a circuit board 30 electrically connected to the first and the second LED light sources 21, 22, a cell box 40 connected to the housing 10 and electrically connected to the circuit board 30, and a flame element 50 for simulating a candle flame. A magnetic element 51 is fixed to a lower end of the flame element 50, and the circuit board 30 includes a coil 31 facing the magnetic element 51 at an interval.

In operation, the circuit board 30 controls a power supply to the coil 31, the magnetic element 51 is pushed or pulled (suffered a Lorentz force when the magnetic element is a magnet, or a magnetic force when the magnetic element is an iron) accordingly so as to swing the flame element 50.

Figure 6:
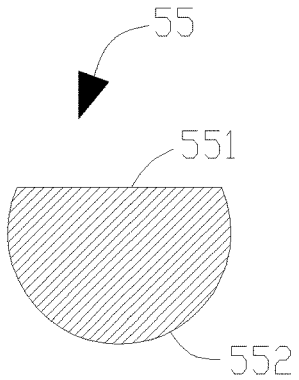
FIG. 6 is a cross-sectional view of a connecting rod of the artificial LED candle in accordance with an embodiment of the present invention.
Figure 7:
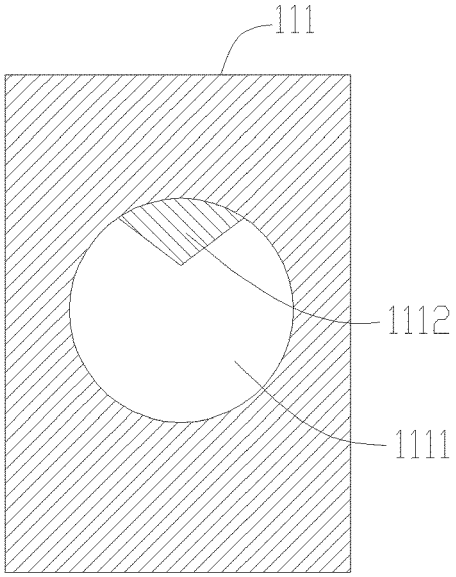
FIG. 7 is a cross-sectional view of a second connecting part of the artificial LED candle in accordance with an embodiment of the present invention.

In detail, the flame element 50 includes an upper section 52 with a flame silhouette outlook, a lower section 53 and a middle section 54 connecting the upper section 52 and the lower section 53. The middle section 54 is rotatably connected to an inner side of an upper part 11 of the housing 10. In the embodiment, two connecting rods 55 extend outwardly from two opposite sides of the middle section 54 of the flame element 50, respectively. And two second connecting parts 111 extend from the inner side of the upper part 11 of the housing 10. Each second connecting part 111 defines a receiving hole 1111 (see FIG. 7) used for receiving a free end of a corresponding connecting rod 55. In the embodiment, please refer to FIG. 6 and FIG. 7, the free end of each connecting rod 55 has a substantially semi-circular cross-section, when facing the substantially semi-circular cross-section, the connecting rod 55 includes a flat part (edge) 551 and a circular arced part (edge) 552. Each receiving hole 1111 has one or two protruding parts 1112 used for limiting a rotating range of the connecting rod 55. In the embodiment, there is only one fan-shaped cross-section of the protruding part 1112. When the connecting rod 55 rotates to two positions where the flat part (edge) 551 touches one of side walls of the protruding part 1112, it is stopped. In other embodiments, there may be two post-shaped protruding parts, when the connecting rod 55 rotates to two positions where the flat part (edge) 551 touches one of the post-shaped protruding parts, it is stopped. In further other embodiments, the two post-shaped protruding parts may be replaced by protruding parts with other shapes.

In other embodiments, the connecting rods 55 and the second connecting part 111 may exchange their positions, that is, the connecting rods are arranged on the housing 10, and the second connecting parts 111 extend out from the middle section 54 of the flame element 50.

As described above, the magnetic element 51 is fixed to a lower end of the flame element 50. In the embodiment, a hole or slot 531 is defined in the lower surface 532 of the lower section 53. The coil 31 is fixed right behind the magnetic element 51 when the flame element 50 stays still in a vertical direction perpendicular with the horizontal direction. The coil 31 is wounded around the vertical direction. The magnetic element 51 is a permanent bipolar magnet, and its two magnetic poles facing two long sides of the coil 31 at an interval.

The first and the second LED light sources 21, 22 are removably connected to the housing 10, and emit light towards the upper section 52 of the flame element 50 to illuminate the upper section 52 of the flame element 50. Particularly, the first LED light source 21 is arranged to illuminate a center part 521 (circled by a dashed line in FIG. 3A) of the upper section 52 of the flame element 50 to simulate a center part of a real candle flame. The second LED light source 22 is arranged to illuminate at least two side parts 522 (around the area which is circled by the dashed line in FIG. 3A) of the upper section 52 of the flame element 50 to simulate side parts of a real candle flame. In the embodiment, the second LED light source 22 is arranged to illuminate both the center part 521 and the two side parts 522 of the upper section 52. As a result, the center part 521 of the upper section 52 is illuminated by both the first and the second LED light sources 21, 22, while the two side parts 522 of the upper section 52 is illuminated only by the second LED light source 22. Therefore, a center part 521 is brighter than the two side parts 522 of the upper section 52 of the flame element 50, just like a real burning candle flame. Color simulation presented on the flame element is more realistic, a simulate effect is improved. The shape of the center part 521 circled by the dashed line in FIG. 3A is just for readers to understand easily, it may be shaped just like an area bracketed by the two dashed line s 521' and 522' as shown in FIG. 3B in another embodiment.

In the embodiment, the first and the second LED light sources 21, 22 are arranged side by side. In other embodiments, they may be arranged one above the another along a vertical direction, as long as the center part 521 of the upper section 52 is illuminated by both the first and the second LED light sources 21, 22, while the two side parts 522 of the upper section 52 is illuminated only by the second LED light source 22.

In other embodiments, there may be two or more first LED light sources arranged to illuminate the center part of the upper section.

In further other embodiments, there may be two second LED light sources arranged at two sides of the first LED light source, each second LED light source is used to illuminate at least one side part 522 of the upper section 52 of the flame element. When the second LED light source only illuminates one side part of the upper section of the flame element, the first LED light source should be brighter than the second LED light source.

Furthermore, a through hole 523 is defined in the upper section 52 of the flame element 50 to simulate a candle wick. Preferably, the through hole 523 is within the center part 521. And the through hole 523 in the upper section 52 of the flame element 50 tapers off from top to bottom. That is, a width of the hole 55 becomes narrower gradually from top to bottom. A top edge 5231 defining the through hole 523 in the flame element 50 is arched. When the first and the second LED light sources 21, 22 are powered, light beams emitting towards the through hole 523 pass through the through hole 523, therefore it looks like dark and black, seems like the candle wick.

The housing 10 is substantially cylindrical, its upper part 11 is slightly narrower than a lower part 12. A top surface 112 of the upper part 11 defines an opening 113. The two second connecting parts 111 are arranged near the opening 113, such that the upper section 52 of the flame element 50 is exposed through the opening 113 while the lower section 53 and the middle section 54 are received in the housing 10. Particularly, a wax layer 60 (only shown in FIG. 4 and FIG. 5) made from wax covers at least the top surface 112 and a part of the opening 113 of the housing 10. The wax layer 60 is unable to interfere with the swinging movement of the flame element 50, and can prevent the users from seeing the inner elements of the artificial candle. Therefore ensure the integrity of the entire artificial LED candle The circuit board 30 may be fixed to a middle part or a lower part of the lower part 12 such that the coil 31 can be positioned right behind the magnetic element 51 when the flame element 50 stays still in the vertical direction.

For the purpose of mounting and fixing the first LED light source 21 and the second LED light source 22, the side wall of the lower part 12 of the housing 10 defines a mounting hole 121, and a supporting plate 122 extends inwardly and upwardly from a lower edge 123 defining the mounting hole 121. Another supporting plate 125 extends perpendicularly from the supporting plate 122 outwardly. The first and the second LED light sources 21, 22 are removably fixed to the supporting plates 122, 125. A cover (not shown) may be used to cover the mounting hole 121.

In other embodiments, the mounting hole 121 and/or the supporting plates 122, 125 may be omitted. The first LED light source 21 and the second LED light source 22 may be fixed to the inner of the side wall via other frame(s) as long as they can illuminate predetermined area of the upper section of the flame element 50.

The cell box 40 is connected to a lower end 13 of the housing 10 and used for receiving a battery or a power adapter. It is understandably, a power interface is set in the cell box 40 when the battery is applicable, and the power interface is omitted when a power adapter is applicable.

Figure 2:
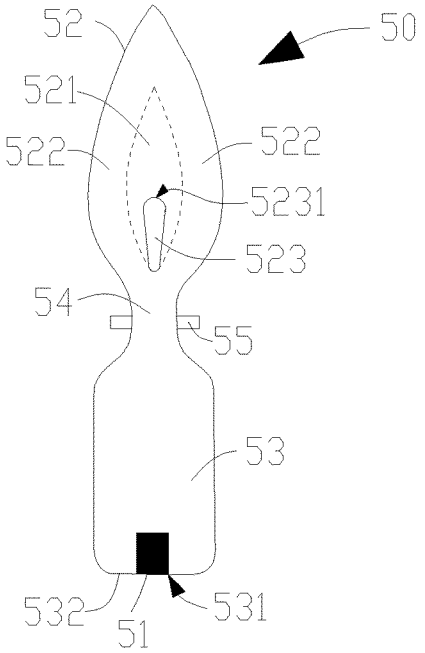
FIG. 2 is a main view of a flame element of the artificial LED candle in accordance with an embodiment of the present invention.
Figure 3:
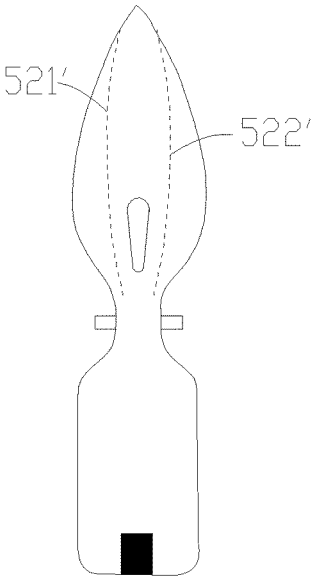
FIG. 3 is a main view of a flame element of an artificial LED candle in accordance with another embodiment of the present invention.
Figure 4:
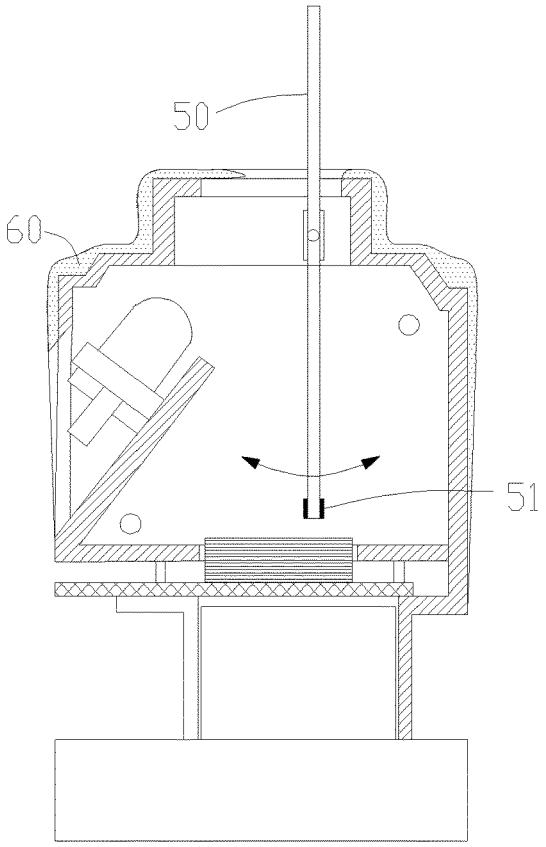
FIG. 4 is a cross-sectional view of the first part of the housing, installed with the LED light sources, the circuit board, a flame element and the cell box, of the artificial LED candle.
Figure 5:
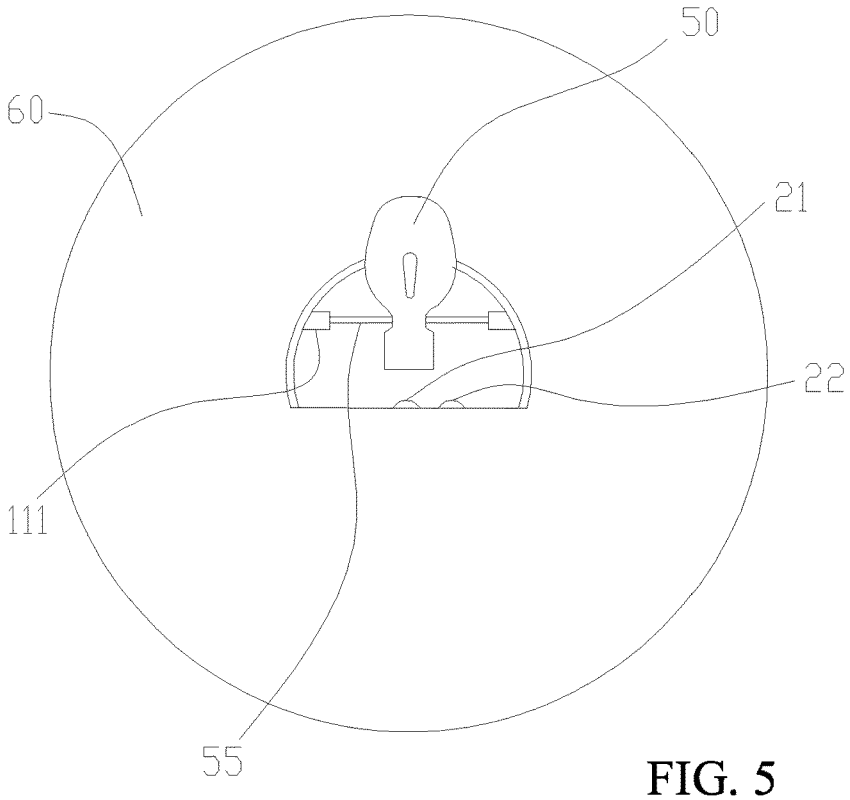
FIG. 5 is a top view of the artificial LED candle with the flame element tilt slightly.

For the purpose of removing and change or maintain the first LED light source 21 and the second LED light source 22, and other elements, the housing 10 is separated into two detachable parts, a first part 14 shown in FIG. 1 and a second part 15 shown in FIG. 2, along a vertical plane perpendicular with the horizontal plane. The first part 14 and the second part 15 are symmetrical in structure. The first part may include several pins 141, and the second part 15 includes several plug parts 151 matched with the pins 141. The first part 14 and the second part 15 of the housing 10 are connected together via the pins 141 and plug parts 151.

When the artificial LED candle is powered on, the, and the light emitted from the LED light sources 21, 22 hits the upper section 52 of the flame element 50, and the upper section 52 of the flame element 50 reflects the light so that the human eyes see the flame shape of the candle. At the same time, changing current is supplied to the coil 31, the magnetic element 51 swings to drive the flame element 50 swing back and forth (left and right in FIG. 4) around the connecting rods 55, therefore simulated flame seems to be flickering and swaying, just like a real candle flame. Furthermore, the through hole 523 in the flame element allows the light to pass through in order to simulate the black candle wick.

Further more, in order to facilitate control of the present invention, the circuit board of the embodiment may be provided with a remote control function, that is, a remote control receiving module added in the control circuit, and a switch of the LED light sources is controlled by a corresponding remote controller. Such remote control receiving modules and corresponding remote controllers are conventional technologies and will not be described in detail here.

To sum up, the flame element of the present invention is rotatably connected to the housing. The flame element swings back and forth by the cooperation of the magnetic member and the energizing coil arranged at the bottom. The LED light sources arranged in the housing illuminate the flame element to illuminate a real candle flame with different light shadow. The center of the flame element is provided with a through hole for simulating the candle wick. When the light is irradiated at this position, a black area is formed which is similar to a wick of candle light. Moreover, the quantity of the LED light sources of the present invention is at least two, the LED light sources illuminating the center position of the flame element is separated from the LED light source irradiated on the periphery according to the true flame color (light shadow) of a candle, so that the center part and the side parts of the upper section of the flame element present a more realistic color. In addition, the cross-section of the connecting rod for mounting the flame element is designed as a semi-circular shape to prevent the swinging amplitude of the flame element from being too large. When the flame element rotates to reach a certain angle, it is blocked. As a result, the flame element is prevented from swinging in one direction, increasing the stability of the entire artificial LED candle. At the same time, the wax layer partially shields the top opening without affecting the swing of the flame element, so that the position of the flame element installed in the middle of the upper end surface of the candle-like light will not form a large gap and affect the overall aesthetic effect of the artificial LED candle.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. An artificial LED candle, comprising:

a housing defining an opening in a top surface thereof;

a flame element comprising:

an upper section with a flame silhouette outlook;

a lower section; and a middle section connecting the upper section and the lower section and rotatably connected to an inner side of an upper part of the housing, such that the upper section of the flame element being exposed through the opening while the lower section and the middle section being received in the housing;

a magnetic element fixed to a lower end of the lower section of the flame element;

at least one first LED light source configured for illuminating a center part of the upper section of the flame element to simulate a center part of a candle flame;

at least one second LED light source configured for illuminating at least two side parts of the upper section of the flame element to simulate side parts of a candle flame; and a circuit board electrically connected with the first and the second LED light sources and comprising a coil facing the magnetic element at an interval;

wherein the circuit board is configured for controlling a power supply to the coil so as to swing the flame element.

2. The artificial LED candle of claim 1, wherein the first and the second LED light sources are arranged side by side or one above the another.

3. The artificial LED candle of claim 2, wherein the side wall of the housing defines at least one mounting hole, at least one supporting plate extends inwardly and upwardly from a lower edge defining the at least one mounting hole; the first and the second LED light sources are removably fixed to the at least one supporting plate and an upper edge defining the at least one mounting hole.

4. The artificial LED candle of claim 2, wherein a through hole is defined in the flame element to simulate a candle wick, and the through hole in the flame element tapers off from top to bottom.

5. The artificial LED candle of claim 4, wherein a top edge defining the through hole in the flame element is arched.

6. The artificial LED candle of claim 1, wherein a through hole is defined in the flame element to simulate a candle wick, and the through hole in the flame element tapers off from top to bottom.

7. The artificial LED candle of claim 6, wherein a top edge defining the through hole in the flame element is arched.

8. The artificial LED candle of claim 6, wherein two connecting rods extend outwardly from two sides of the middle section of the flame element, respectively; two second connecting part extend from the inner side of the upper part of the housing; each second connecting part defines a receiving hole configured for receiving an free end of a corresponding connecting rod.

9. The artificial LED candle of claim 8, wherein the free end of each connecting rod has a substantially semi-circular cross-section and comprises a flat part and a circular arced part; each receiving hole has one or two protruding parts configured for limiting a rotating range of the connecting rod.

10. The artificial LED candle of claim 6, wherein a wax layer covers the top surface and a part of the opening of the housing.

11. The artificial LED candle of claim 6, wherein the coil is configured right behind the magnetic element when the flame element stays still, and the magnetic element is fixed to a lower surface of the lower end of the flame element.

12. The artificial LED candle of claim 11, wherein the magnetic element is a permanent bipolar magnet or an iron.

13. The artificial LED candle of claim 1, further comprising a cell box connected to a lower end of the housing and configured for receiving a battery or a power adapter; the cell box is electrically connected to the circuit board.

14. The artificial LED candle of claim 1, wherein the housing is separated into two detachable parts, a first part and a second part, and the first part and the second part are symmetrical in structure.

15. The artificial LED candle of claim 14, wherein the first part comprises a plurality of pins, and the second part comprises corresponding plug parts matched with the plurality of pins; the first part and the second part are connected together via the plurality of pins and plug parts.

* * * * *